US009057518B2

(12) United States Patent
Buss et al.

(10) Patent No.: US 9,057,518 B2
(45) Date of Patent: Jun. 16, 2015

(54) REHEAT BURNER

(75) Inventors: Johannes Buss, Hohberg (DE); Andrea Ciani, Zürich (CH); Adnan Eroglu, Untersiggenthal (CH); Urs Benz, Gipf-Oberfrick (CH); Michael Düsing, Rheinfelden (DE); Michael Hutapea, Baden (CH)

(73) Assignee: ALSTOM TECHNOLOGY LTD., Baden (CH)

( * ) Notice: Subject to any disclaimer, the term of this patent is extended or adjusted under 35 U.S.C. 154(b) by 928 days.

(21) Appl. No.: 13/195,993

(22) Filed: Aug. 2, 2011

(65) Prior Publication Data

US 2012/0036824 A1 Feb. 16, 2012

(30) Foreign Application Priority Data

Aug. 16, 2010 (EP) ..... 10172941

(51) Int. Cl.

| | |
|---|---|
| ***F23R 3/00*** | (2006.01) |
| ***F23D 11/40*** | (2006.01) |
| ***F23R 3/12*** | (2006.01) |
| ***F23D 14/64*** | (2006.01) |
| ***F23R 3/20*** | (2006.01) |

(52) U.S. Cl.

CPC ..... *F23D 11/402* (2013.01); *F23R 3/002* (2013.01); *F23R 3/12* (2013.01); *F23R 2900/03341* (2013.01); *F23D 11/408* (2013.01); *F23D 14/64* (2013.01); *F23R 3/20* (2013.01)

(58) Field of Classification Search

CPC ..... F02C 6/003; F23R 3/002; F23R 3/04; F23R 3/12; F23R 2900/03341; F23C 2900/07002; F23C 2900/07021

USPC ..... 60/751–760, 774, 791, 39.17

See application file for complete search history.

(56) References Cited

U.S. PATENT DOCUMENTS

| | | | | |
|---|---|---|---|---|
| 5,253,478 | A * | 10/1993 | Thibault et al. | 60/733 |
| 5,497,611 | A * | 3/1996 | Benz et al. | 60/776 |
| 5,513,982 | A * | 5/1996 | Althaus et al. | 431/350 |

(Continued)

FOREIGN PATENT DOCUMENTS

| | | |
|---|---|---|
| DE | 199 48 673 A1 | 4/2001 |
| DE | 10026122 | 11/2001 |

(Continued)

OTHER PUBLICATIONS

Guatafson, Vortex Methods and Vortex Motion, 1991, Society for Industrial and Applied Mathematics, p. 12.*

(Continued)

*Primary Examiner* — William H Rodriguez
*Assistant Examiner* — William Breazel
(74) *Attorney, Agent, or Firm* — Buchanan Ingersoll & Rooney PC

(57) ABSTRACT

A reheat burner (1) includes a channel (2) with a lance (3) protruding thereinto to inject a fuel over an injection plane (4) perpendicular to a channel longitudinal axis (15). The channel (2) and lance (3) define a vortex generation zone (6) upstream of the injection plane (4) and a mixing zone (9) downstream of the injection plane (4) in the hot gas (G) direction. The mixing zone (9) includes a high speed area (16) with a constant cross section, and a diffusion area (17) with a flared cross section downstream of the high speed area (16) in the hot gas (G) direction.

14 Claims, 3 Drawing Sheets

(56) References Cited

U.S. PATENT DOCUMENTS

| | | | | |
|---|---|---|---|---|
| 5,673,551 | A | 10/1997 | Dobbeling | |
| 2002/0187448 | A1* | 12/2002 | Eroglu et al. | 431/350 |
| 2007/0130951 | A1 | 6/2007 | Choi et al. | |

FOREIGN PATENT DOCUMENTS

| | | | |
|---|---|---|---|
| EP | 0287392 | | 10/1988 |
| EP | 1265029 | | 12/2002 |
| EP | 2211109 | | 7/2010 |
| JP | 7-71758 | A | 3/1995 |
| JP | 7-280224 | A | 10/1995 |
| JP | 7-310909 | A | 11/1995 |
| JP | 7-317567 | A | 12/1995 |
| JP | 8-189641 | A1 | 7/1996 |
| JP | 9-119641 | A | 5/1997 |
| JP | 2001-012740 | A | 1/2001 |
| JP | 2002-162037 | A | 6/2002 |
| JP | 2009-508037 | A | 2/2009 |
| JP | 2010-85086 | A | 4/2010 |
| WO | WO2006/069861 | | 7/2006 |

OTHER PUBLICATIONS

European Search Report for EP Patent App. No. 10172941.6 (Apr. 5, 2011).

Japanese Office Action issued on Sep. 8, 2014, by the Japanese Patent Office in corresponding Japanese Patent Application No. 2011-175693, and an English Translation of the Office Action. (8 pages).

* cited by examiner

REHEAT BURNER

This application claims priority under 35 U.S.C. §119 to European Application No. 10172941.6, filed 16 Aug. 2010, the entirety of which is incorporated by reference herein.

BACKGROUND

1. Field of Endeavor

The present invention relates to a reheat burner.

2. Brief Description of the Related Art

Sequential combustion gas turbines are known to include a first burner, in which a fuel is injected into a compressed air stream to be combusted generating flue gases that are partially expanded in a high pressure turbine.

The flue gases coming from the high pressure turbine are then fed into a reheat burner, in which a further fuel is injected into the reheat burner to be mixed and combusted in a combustion chamber downstream of it; the flue gases generated are then expanded in a low pressure turbine.

FIGS. 1-3 show a typical example of a traditional reheat burner.

With reference to FIGS. 1-3, traditional burners 1 have a quadrangular channel 2 with a lance 3 housed therein.

The lance 3 has nozzles from which a fuel (either oil, i.e., liquid fuel, or a gaseous fuel) is injected; as shown in FIG. 1, the fuel in injected over a plane known as injection plane 4.

The channel zone upstream of the injection plane 4 (in the direction of the hot gases G) is the vortex generation zone 6; in this zone, vortex generators 7 are housed, projecting from each of the channel walls, to induce vortices and turbulence into the hot gases G.

The channel zone downstream of the injection plane 4 (in the hot gas direction G) is the mixing zone 9; typically this zone has plane, diverging side walls, to define a diffuser.

As shown in the figures, the side walls 10 of the channel 2 may converge or diverge to define a variable burner width w (measured at mid height), whereas the top and bottom walls 11 of the channel 2 are parallel to each other, to define a constant burner height h.

The structure of the burners 1 is optimized in order to achieve the best compromise of hot gas speed and vortices and turbulence within the channel 2 at the design temperature.

In fact, a high hot gas speed through the burner channel 2 reduces $NO_x$ emissions (since the residence time of the burning fuel in the combustion chamber 12 downstream of the burner 1 is reduced), increases the flashback margin (since it reduces the residence time of the fuel within the burner 1 and thus it makes it more difficult for the fuel to achieve auto ignition) and reduces the water consumption in oil operation (water is mixed to oil to prevent flashback). In contrast, high hot gas speed increases the CO emissions (since the residence time in the combustion chamber 12 downstream of the burner 1 is low) and pressure drop (i.e., efficiency and achievable power).

In addition, high vortex strength and turbulence level reduce the $NO_x$ and CO emissions (thanks to the good mixing), but increase the pressure drop (thus they reduce efficiency and achievable power).

In order to increase the gas turbine efficiency and performances, the temperature of the hot gases at the inlet and exit of the reheat burner 1 should be increased.

Such an increase causes the delicate equilibrium among all the parameters to be missed, such that a reheat burner operating with hot gases having a higher temperature than the design temperature may have flashback, $NO_x$, CO emissions, water consumption and pressure drop problems.

SUMMARY

One of numerous aspects of the present invention includes a reheat burner addressing the aforementioned problems of the known art.

Another aspect includes a reheat burner that may safely operate without incurring or with limited risks of flashback, $NO_x$, CO emissions, water consumption and pressure drop problems, in particular when operating with hot gases having temperatures higher than in traditional burners.

BRIEF DESCRIPTION OF THE DRAWINGS

Further characteristics and advantages of the invention will be more apparent from the description of a preferred but non-exclusive embodiment of the reheat burner, illustrated by way of non-limiting example in the accompanying drawings, in which.

DETAILED DESCRIPTION OF EXEMPLARY EMBODIMENTS

Figure 1:
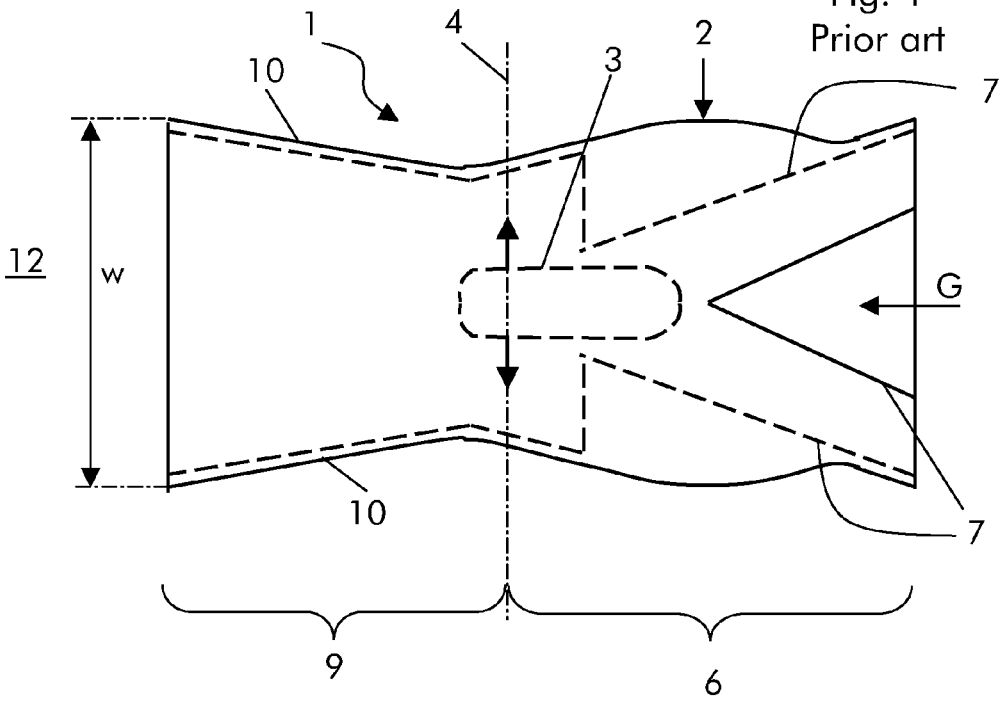
Fig. 1 Prior art
FIGS. 1, 2, 3 are, respectively, a top view, a side view, and a front view of a traditional reheat burner.
Figure 2:
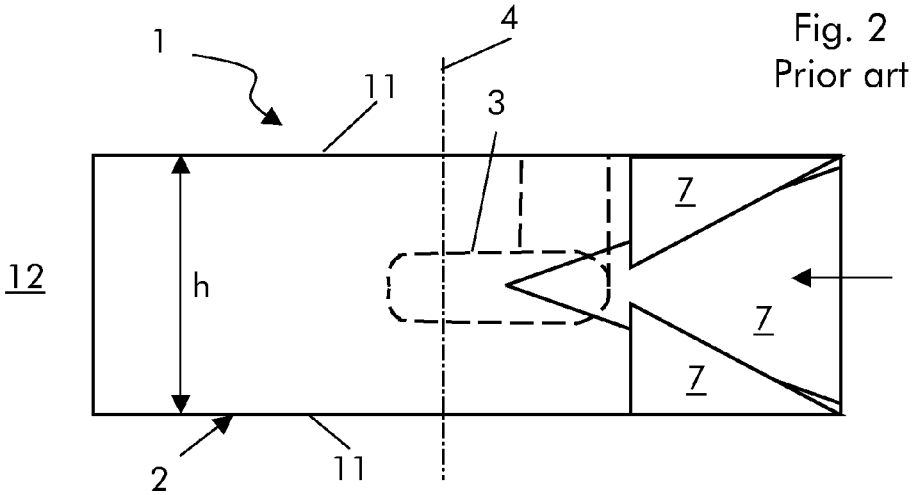
Fig. 2 Prior art
Figure 3:
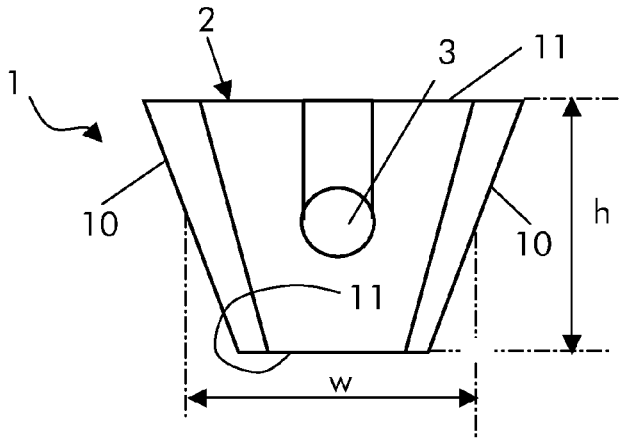
Fig. 3 Prior art

With reference to the figures, a reheat burner is illustrated; in the following, like reference numerals designate identical or corresponding parts throughout the several views.

The reheat burner 1 includes a channel 2 with a quadrangular, square or trapezoidal cross section.

A lance 3 protrudes into the channel 2 to inject a fuel over an injection plane 4 perpendicular to a channel longitudinal axis 15.

The channel 2 and lance 3 define a vortex generation zone 6 upstream of the injection plane 4 and a mixing zone 9 downstream of the injection plane 4 in the hot gas G direction.

The mixing zone 9 includes a high speed area 16 with a constant cross section, and a diffusion area 17 with a flared cross section downstream of the high speed area 16 in the hot gas G direction.

The high speed area 16 has the smallest cross section of the burner 1.

In addition, upstream of the high speed area 16, the mixing zone 9 has a contracting area 18.

Figure 4:
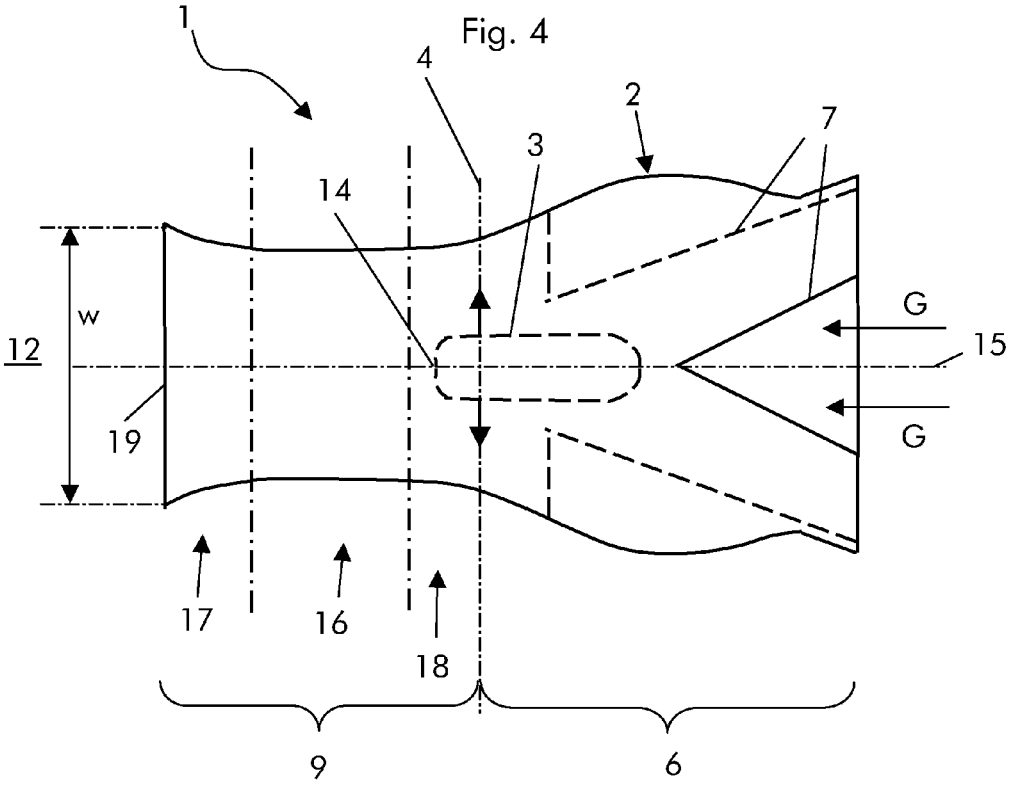
FIGS. 4, 5, 6 are, respectively, a top view, a side view, and a front view of a reheat burner in an embodiment of the invention.
Figure 5:
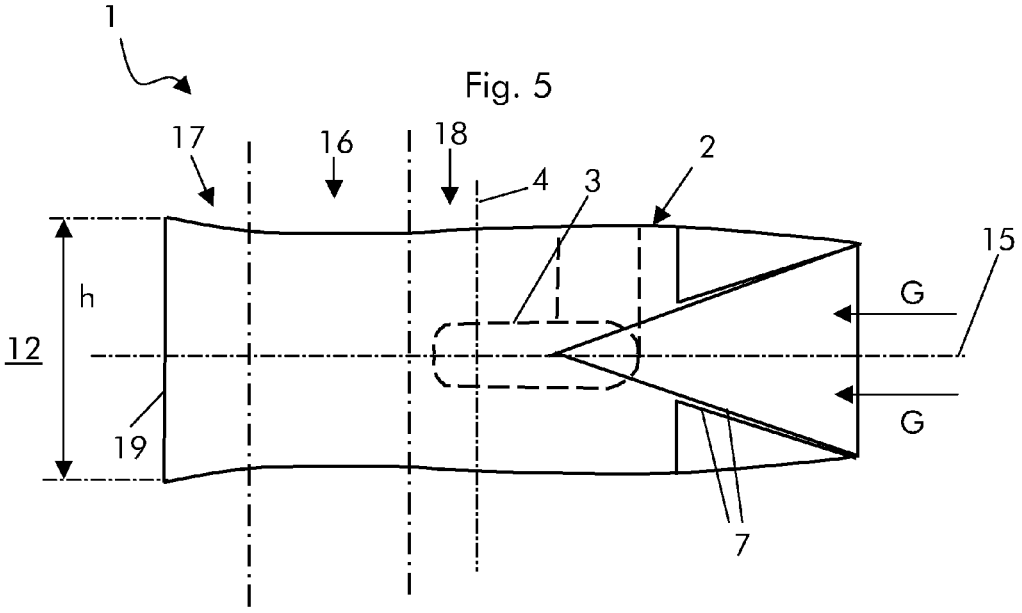
Figure 6:
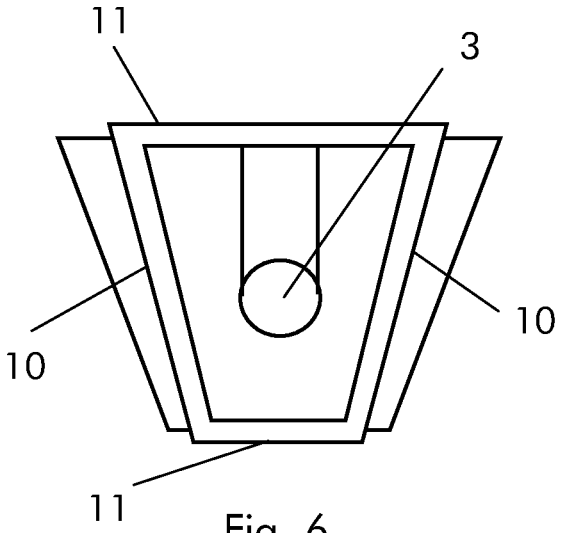

As clearly shown in FIGS. 4 and 5, both the width w and the height h of the diffusion area 17 increase toward a burner outlet 19. Advantageously, increase of width w and height h of the diffusion area is compatible with the flow detachment, i.e., it is such that no flow separation from the diverging walls of the diffusion area 17 occurs. In this respect, the diffusion area defines a so-called Coanda diffuser.

The vortex generation zone 6 has a section wherein both its width w and height h change (i.e., they increase and decrease) toward the burner outlet 19.

Advantageously, a lance tip 14 is upstream of the high speed area 16.

Figure 7:
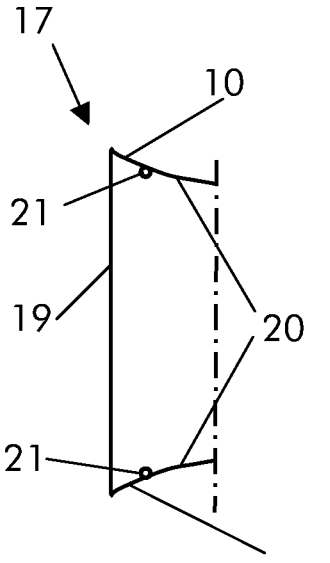
FIGS. 7 and 8 are enlarged views of a portion of FIGS. 4 and 5 in a different embodiment of the invention.
Figure 8:
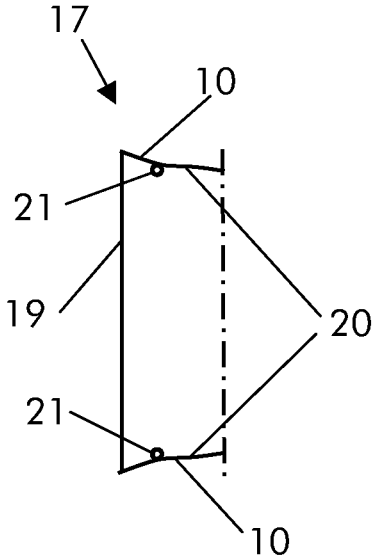

In a preferred embodiment (FIGS. 7 and 8), the inner wall 20 of the diffusion area 17 has a protrusion 21 defining a line where the hot gases flowing within the burner 1 detach from the diffusion area inner wall 20. The protrusion 21 extends circumferentially within the diffusion area inner wall 20.

The operation of a reheat burner embodying principles of the present invention is apparent from that described and illustrated and is substantially the following.

Hot gases G enter the channel 2 of the burner 1 and pass through the vortex generation zone 6, wherein they increase their vortices and turbulence. Since both the width w and height of the cross section zone increase (at least at the centre of the vortex generation zone 6), its cross section is substantially larger than the vortex generation zone cross section of a traditional burner generating comparable vortices and turbulence in hot gases passing through them. This allows lower pressure drop to be induced in the hot gases than in traditional burners.

Then, when the hot gases pass through the mixing zone 9, they are accelerated in the contracting area 18 at their maximum speed; thus the hot gases substantially keep this high speed when passing through the high speed area 16.

Since the hot gases pass through the high speed area 16 with a high speed, the residence time of the fuel within the burner is low and the risk of flashback, water consumption and $NO_x$ emission are reduced.

In addition, thanks to the particular configuration with lance tip 14 upstream of the high speed area 16 (in the hot gas direction) and housed in the contracting area 18, the hot gases keep accelerating up to a location downstream of the lance tip 14, such that risks that the flame travels upstream of the lance tip 14 and, consequently, causes flashback are reduced; this allows a reduced flashback risk and oil operation with a reduced amount of water.

After the high speed area 16, the hot gases pass through the diffusion area 17, where their speed decreases and a portion of the kinetic energy is transformed into static pressure. Deceleration allows the hot gases containing fuel that passed through the high speed zone fast (i.e., at a high speed) to reduce their speed, such that they enter the combustion chamber 12 downstream of the burner 1 at a low speed; this allows the fuel to have a sufficient residence time in the combustion chamber 12 to completely and correctly burn and achieve low CO emissions. In addition, since a portion of the kinetic energy in transformed to static pressure, the pressure drop suffered in the vortex generation area 6, in the contracting area 18 and in the high speed area 16 is partly compensated for, such that a total low pressure drop over the burner is achieved.

Thus the combination of the vortex generation zone 6, high speed area 16 and diffusion area 17 allows high speed of the hot gases through the channel 2 (and thus low $NO_x$ emissions, large flashback margin and low water consumption in oil operation) and at the same time exit from the burner 1 (to enter the combustion chamber downstream of it) at a low speed, such that residence time in the combustion chamber is high and thus CO emissions are low.

In addition, since a certain downstream shift of the reaction zone is achieved, reaction occurs when mixing quality is better compared to traditional burners; this factor also contributes to reduce NOx emissions.

Moreover, the pressure drop through the whole burner is small, such that efficiency and power of the gas turbine are increased.

Moreover, the protrusion 21, fixing the location where the hot gases detach from the inner wall 20 of the diffusion area 17, prevents unstable flow to be generated and, thus, unstable combustion and pulsations within the combustion chamber.

Naturally the features described may be independently provided from one another.

In practice the materials used and the dimensions can be chosen at will according to requirements and to the state of the art.

REFERENCE NUMBERS

1 burner
2 channel
3 lance
4 injection plane
6 vortex generation zone
7 vortex generator
9 mixing zone
10 side wall
11 top/bottom wall
12 combustion chamber
14 lance tip
15 longitudinal axis of 2
16 high speed area of 9
17 diffusion area of 9
18 contracting area
19 burner outlet
20 inner wall of 17
21 protrusion
G hot gases
h height
w width While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

We claim:

1. A reheat apparatus comprising:

a reheat burner comprising:

a lance;

a channel with an entry for a gas flow which flows in a downstream direction, the lance protruding into the channel, wherein the lance is configured to inject a fuel over an injection plane perpendicular to a channel longitudinal axis;

wherein the channel and the lance define a vortex generation zone upstream of the injection plane and a mixing zone downstream of the injection plane; and wherein vortex generators project from each of the channel walls;

the mixing zone comprising:

a contracting area having a contracting cross section in the downstream direction; and a diffusion area having an expanding cross section in the downstream direction, a high speed area having a constant cross section, the constant cross section extending between the contracting area and the diffusion area, the high speed region being downstream of the contracting area and being upstream of the diffusion area.

2. The reheat apparatus as claimed in claim 1, wherein the high speed area of the mixing zone has the smallest cross section of the burner.

3. The reheat apparatus as claimed in claim 1, wherein both a width and a height of the diffusion area increase in the downstream direction.

4. The reheat apparatus as claimed in claim 3, wherein the increase of width and height of the diffusion area is compatible with flow detachment.

5. The reheat apparatus as claimed in claim 4, wherein the diffusion area comprises an inner wall having a protrusion defining a line at which the gas flow detaches from the diffusion area inner wall when flowing through the channel.

6. The reheat apparatus as claimed in claim 5, wherein the protrusion extends circumferentially within the diffusion area inner wall.

7. The reheat apparatus as claimed in claim 1, wherein the vortex generation zone comprises at least one section wherein both a width and a height increase in the downstream direction.

8. The reheat apparatus as claimed in claim 1, wherein said channel has a quadrangular, square, or trapezoidal cross section.

9. The reheat apparatus as claimed in claim 1, wherein the lance comprises a tip upstream of the high speed area.

10. The reheat apparatus as claimed in claim 1, wherein the channel has quadrangular cross section.

11. The reheat apparatus as claimed in claim 1, wherein the channel has a square cross section.

12. The reheat apparatus as claimed in claim 1, wherein the channel has a trapezoidal cross section.

13. The reheat apparatus as claimed in claim 1, wherein the channel includes a top wall, a bottom wall, and a pair of side walls.

14. The reheat apparatus as claimed in claim 13, wherein the top wall and the bottom wall are parallel to each other.

* * * * *